United States Patent [19]

Prader

[11] Patent Number: 4,623,111

[45] Date of Patent: Nov. 18, 1986

[54] WIRE HOLDER FOR HANDLED PLASTIC BAGS

[75] Inventor: Randolph D. Prader, Fairport, N.Y.

[73] Assignee: Mobil Oil Corporation, New York, N.Y.

[21] Appl. No.: 685,588

[22] Filed: Dec. 24, 1984

[51] Int. Cl.[4] ..... A63B 55/04

[52] U.S. Cl. ..... 248/97; 220/404

[58] Field of Search ..... 248/97, 95, 98, 99, 248/101, 100; 53/390, 384; 141/390, 391; 232/43.2; 220/6, 404; 150/51

[56] References Cited

U.S. PATENT DOCUMENTS

| | | | |
|---|---|---|---|
| 447,686 | 3/1891 | Holladay | 248/97 |
| 2,638,399 | 5/1953 | Seymour | 232/43.2 U X |
| 3,260,488 | 7/1966 | Kliewer et al. . | |
| 3,352,520 | 11/1967 | Bumgarner et al. | 248/97 X |
| 3,595,507 | 7/1971 | Kurlander | 232/43.2 X |
| 3,603,541 | 9/1971 | Sturm | 248/97 |
| 3,603,542 | 9/1971 | Grille | 248/98 |
| 3,768,763 | 10/1973 | Hembree | 248/99 X |
| 3,815,933 | 6/1974 | Olson | 248/98 X |
| 3,838,839 | 10/1974 | Spencer . | |
| 3,905,406 | 9/1975 | Cruz . | |
| 4,062,170 | 12/1977 | Orem . | |
| 4,165,832 | 8/1979 | Orem et al. . | |
| 4,267,997 | 5/1981 | Meier | 248/97 |
| 4,364,534 | 12/1982 | Valesko . | |
| 4,418,835 | 12/1983 | Watts | 220/404 |
| 4,458,867 | 7/1984 | Valesko . | |
| 4,469,300 | 9/1984 | Valesko . | |
| 4,487,388 | 12/1984 | Provan | 248/99 X |

FOREIGN PATENT DOCUMENTS

| | | | |
|---|---|---|---|
| 260340 | 8/1964 | Australia | 248/99 |
| 1464798 | 11/1966 | France | 248/97 |

OTHER PUBLICATIONS

Photograph of wire grocery bag holder.

*Primary Examiner*—J. Franklin Foss

*Attorney, Agent, or Firm*—Alexander J. McKillop; Michael G. Gilman; Charles J. Speciale

[57] ABSTRACT

A wire holder for open mouth plastic bags having integral loop handles has tabs integrally formed from the top wire pieces and extending downwardly to suspend the bags in an open position. Base, longitudinal, vertical and top wire pieces form a substantially rectangular wire frame which can be collapsed into a flat condition prior to use and which can be easily assembled into a holder having good stability during use.

12 Claims, 8 Drawing Figures

WIRE HOLDER FOR HANDLED PLASTIC BAGS

BACKGROUND OF THE INVENTION

This invention relates to holders for supporting limp plastic bags having carrying handles, and more particularly to an inexpensive holder which can be used in conjunction with the bags as a trash holder.

Thin film plastic bags are now extensively used for carrying groceries and as trash containers. U.S. Pat. No. 4,165,832-Orem and Kuklies shows a thin film bag with carrying handles which has been successfully used for carrying groceries. Since these plastic bags are very limp, during loading they must be supported by a holder. U.S. Pat. No. 4,062,170, Orem shows a holder suitable for use in a grocery store during bagging of the groceries. The handles of the plastic bag are looped over elongated tabs on the holder to support the bag during loading. Such holders are well suited for grocery store use where durability over extensive use is a consideration. This type of holder is not suitable for home use where inexpensive initial cost is the principal consideration.

Holders for supporting plastic trash bags for use in the home have been proposed. U.S. Pat. Nos. 3,905,406, Cruz; 3,838,839, Spencer; and 3,260,488, Kliewer, et al are typical. These prior art holders do not have the combination of low initial cost, reliablity, and easy use which is desirable for home use.

U.S. Pat. Nos. 4,364,534 and 4,469,300 and 4,458,867, Malik, show wire holders for plastic trash bags used in the home. These holders have upright tabs on which the bag handles are suspended, but the handles are easily dislodged. The holders can be folded for shipment and/or storage.

In order to fold the holder, longitudinal support which is important for stability has been omitted. In the first two patents, longitudinal support is omitted from the top of the holder. In the third patent, longitudinal support is provided by a wire member at the top back. Longitudinal support is provided at the bottom by a separate base which is expensive and difficult to ship.

It is an object of the present invention to provide a low cost, durable, holder for handled plastic bags.

SUMMARY OF THE INVENTION

In accordance with the present invention, a substantially rectangular frame is formed from wire pieces including base wire pieces, vertical wire pieces, and top wire pieces. Two of the top wire pieces are bent to form integral tabs from which the handles of a plastic bag can be suspended. In accordance with the invention, the tabs extend downwardly from the horizontal at an angle of about 30° to 45° to prevent the bag from slipping off the holder. The wire holder can be folded flat for shipment and marketing. Thereafter, the holder can be easily assembled into its generally rectangular shape for use.

Further in accordance with the invention, good longitudinal support is provided without the need for a separate base. In one embodiment wire members along all twelve sides of a rectangle provide good stability for the holder.

The holder of the present invention is easily and inexpensively manufactured and marketed with low cost plastic bags making the combination particularly suitable for use as trash containers in the home. The holder can be used as a free-standing trash container, or it can be used as an insert for a conventional trash container, which is thereby adapted to use with easily disposable plastic bags.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
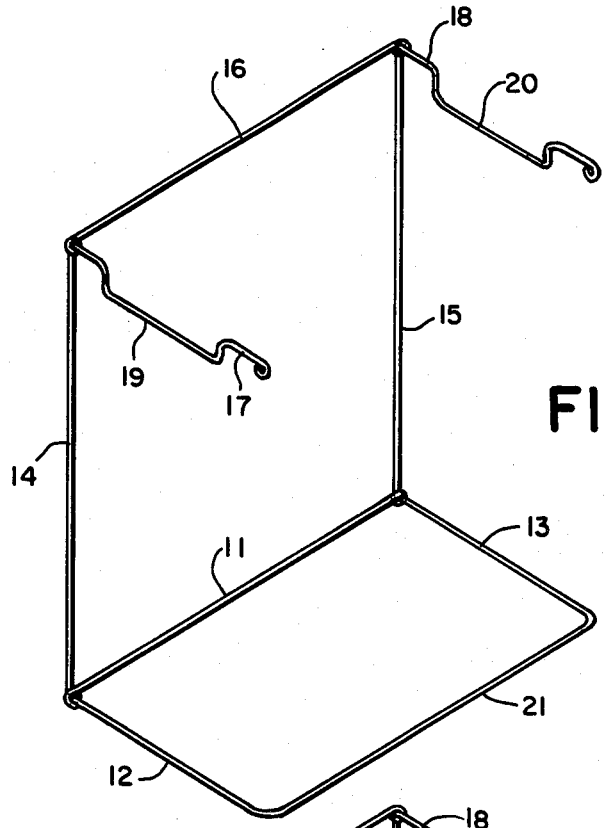
FIG. 1 shows the holder of the present invention.

Referring to FIG. 1, the holder of the present invention is constructed of wire pieces such as ¼" diameter cold rolled steel. It includes a base longitudinal wire piece 11 and two base wire pieces 12 and 13 extending at one end perpendicularly from the ends of the base longitudinal wire piece 11.

Vertical wire pieces 14 and 15 extend at one end thereof from the junctions with base wire piece 11. A top longitudinal wire piece 16 extends between the other ends of the vertical wire pieces 14 and 15.

Two top wire pieces 17 and 18 extend between the junctions respectively of vertical wire piece 14 and top longitudinal wire piece 16 and between vertical wire piece 15 and longitudinal wire piece 16.

Tabs 19 and 20 are integrally formed from top wire pieces 17 and 18. The handles of the plastic bags are looped over the tabs 19 and 20 to suspend one of the bags in an open position for receiving trash. The tabs extend downwardly from the two top wire pieces to hold the handles of the bag.

A second base longitudinal wire piece 21 extends between the other ends of base wire pieces 12 and 13.

In the embodiment of FIG. 1, base wire pieces 12 and 13, vertical wire pieces 14 and 15, top wire pieces 19 and 20, and second base longitudinal wire piece 21 are formed from an integral wire. The three pieces from which the holder of FIG. 1 is constructed include this integral wire, base longitudinal wire piece 11, and top longitudinal wire piece 16. 360° bends in the ends of top wire pieces 17 and 18 eliminate sharp edges where the wire is cut. 360° loops on both ends of base longitudinal wire piece 11 and top longitudinal wire piece 16 are used to form a stable junction with vertical pieces 14 and 15.

Figure 2:
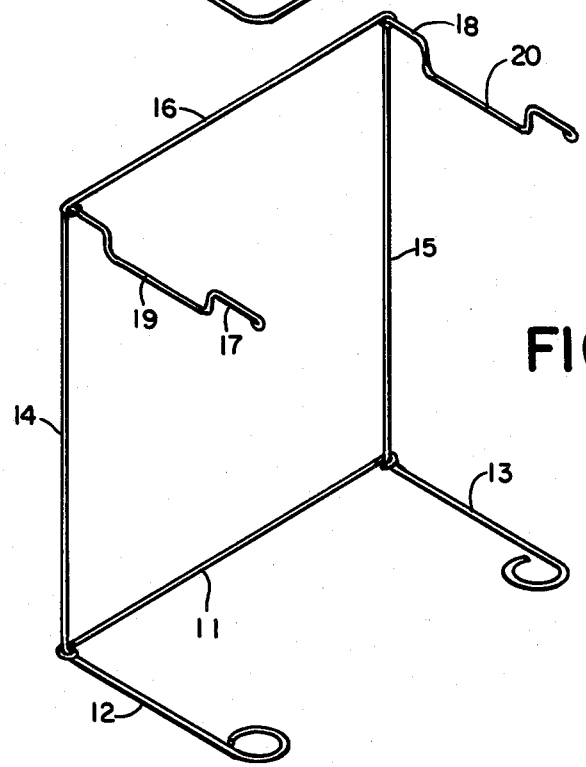
FIG. 2 shows an embodiment which can be easily folded flat for shipment and marketing.

FIG. 2 shows an embodiment of the invention which can be folded flat for shipment and marketing. In FIG. 2, the holder is assembled for use. Loops in the ends of base wire pieces 12 and 13 add statiblity.

Figure 3:
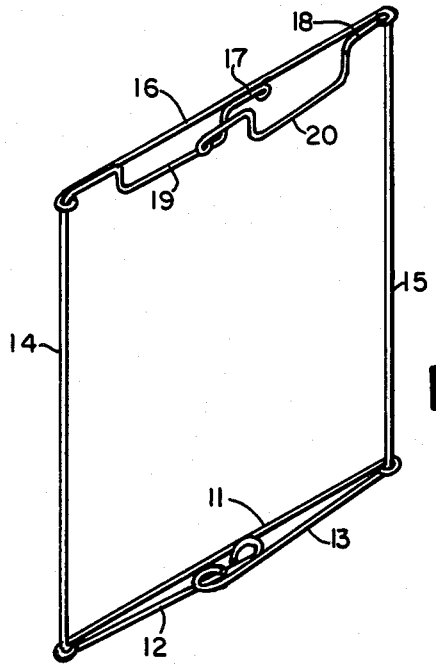
FIG. 3 shows the holder of FIG. 2 collapsed to the flat condition.

FIG. 3 shows the holder of FIG. 2 collapsed into a flat condition prior to use.

Figure 4:
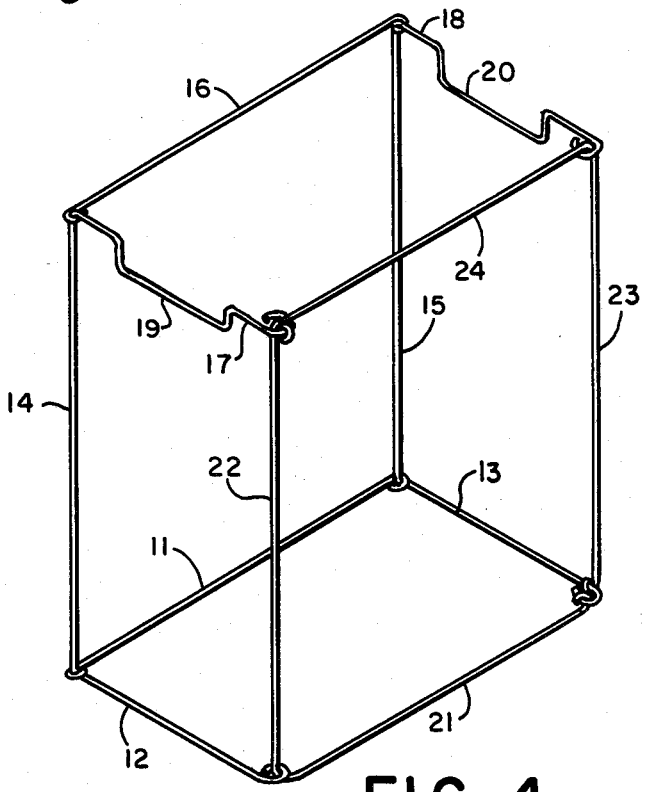
FIG. 4 shows another embodiment which can be easily folded to the flat condition.

FIG. 4 shows a collapsible holder which has improved stability by reason of the addition of second vertical wire pieces 22 and 23 and a second top longitudinal wire piece 24. Second base longitudinal piece 21 is integral with vertical wire piece 22. Vertical wire piece 23 is integral with top longitudinal piece 24.

Figure 5:
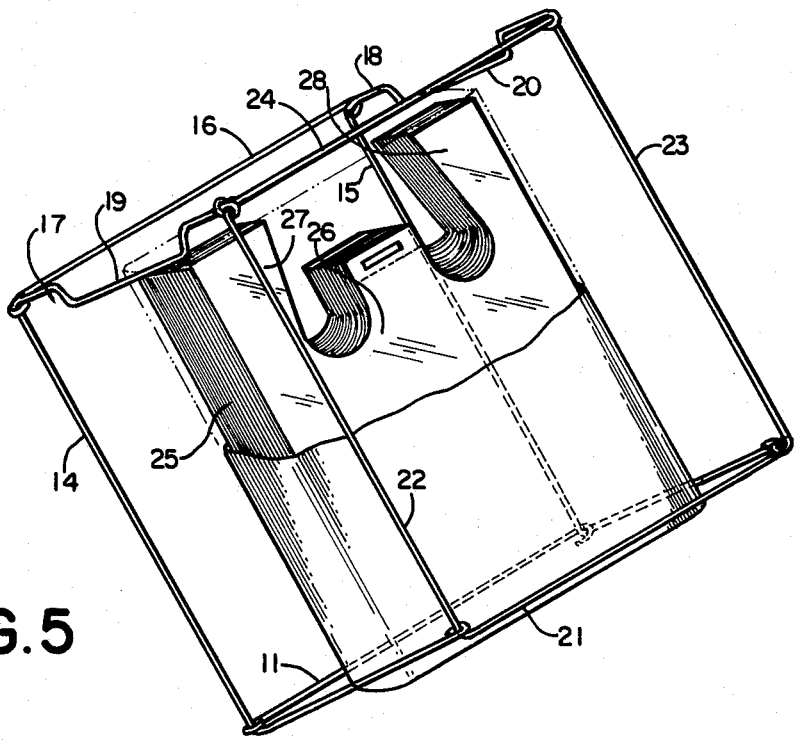
FIG. 5 shows the holder of FIG. 4 collapsed to the flat condition.

The holder can be collapsed into the substantially flat condition shown in FIG. 5 for shipment and marketing. FIG. 5 depicts a pack 25 of plastic bags 26 each having handles 27 and 28. The bag pack can be conveniently packaged for marketing with the flattened holder of the present invention. The holder is easily assembled into the position of FIG. 4 for use with one of the bags in the pack.

Figure 6:
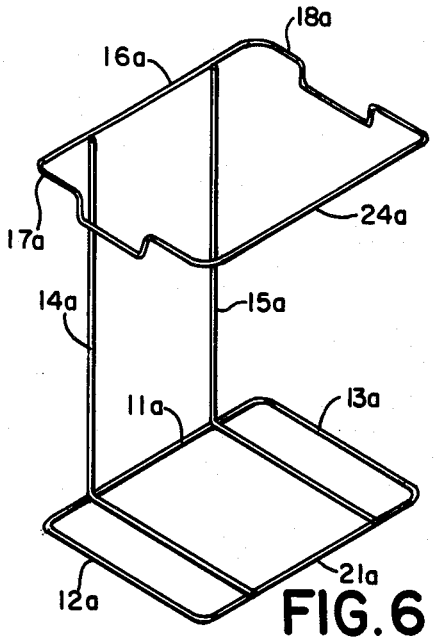
FIG. 6 shows an embodiment with welded joints.

FIG. 6 shows an embodiment wherein the junctions between the wire pieces are welded for even greater stability. In FIG. 6, like reference numerals with the suffix "a" added denote pieces which are like those described in FIGS. 1 and 4.

Figure 7:
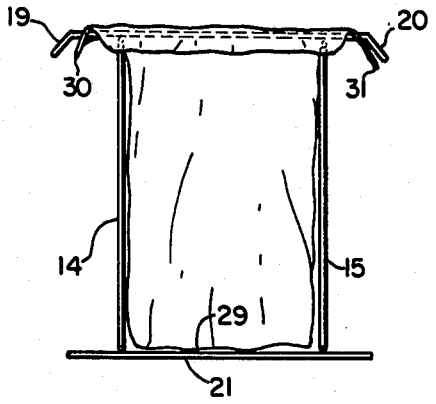
FIG. 7 is a front view showing the angle of the tabs.

FIG. 7 shows a front view of the holder of the present invention. FIG. 7 shows that the tabs 19 and 20 are at an angle of about 30° to 45° from the horizontal to prevent the bag from falling from the holder. A bag 29 has handles 30 and 31 which are looped over the tabs of the holder to suspend the bag.

Figure 8:
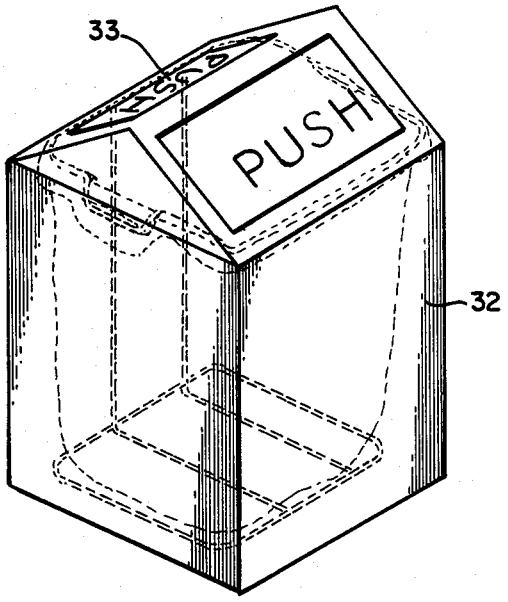
FIG. 8 shows the holder of the present invention used as an insert in a conventional trash container.

FIG. 8 shows the holder of the present invention used as an insert in a conventional trash container 32 of the type having a hinged lid 33. This adapts the container for use with plastic bags which can be easily discarded when filled.

While a particular embodiment has been shown and described, various modifications are within the true spirit and scope of the invention. The claims, therefore, are intended to cover all such modifications.

What is claimed is:

1. A holder for open mouth plastic bags having integral loop handles disposed on opposite sides of the mouth thereof comprising:

a base longitudinal wire piece;

two base wire pieces extending at one end thereof perpendicularly from the ends of said base longitudinal wire piece;

two vertical wire pieces, each extending at one end thereof from the junctions of said base longitudinal wire piece and said two base wire pieces;

a top longitudinal wire piece extending between the other ends of said two vertical wire pieces;

two top wire pieces extending from the junction of said two vertical wire pieces and said top longitudinal wire piece and extending substantially parallel to said two base wire pieces; and tabs integrally formed from said two top wire pieces intermediate the ends thereof, said tabs each comprising three integral sections of one of said top wire pieces, two of said sections extending downwardly from one of said top wire pieces and integrally connected to each other at the lower ends of said two sections by an integral third section, said tabs extending downwardly from said two top wire pieces for suspending one of the bags held in an open position by the handles looped over and in engagement with said downwardly extending sections of said tabs, said tabs extending downwardly through the openings in the handles to prevent the handles from being easily dislodged from said tabs.

2. The holder recited in claim 1 wherein said tabs extend downwardly at an angle about 30° to 45° from the horizontal.

3. The holder recited in claim 1 wherein a base wire piece, vertical wire piece, and top wire piece are formed from an integral piece of wire.

4. The holder recited in claim 3 wherein said base longitudinal wire piece and said top longitudinal wire piece each have loops at the ends thereof, encompassing the junctions between said base and top wire pieces with said vertical wire pieces, whereby said two base wire pieces and said top wire pieces can be folded flat against said base and top longitudinal wire pieces for shipment and storage.

5. The holder recited in claim 1 wherein the ends of said base wire pieces are bent in 360° loops to add stability.

6. The holder recited in claim 1 further comprising:

a second base longitudinal wire piece extending between the other ends of said two base wire pieces.

7. The holder recited in claim 1 further comprising:

a second base longitudinal wire piece, a second top longitudinal wire piece, and two further vertical wire pieces to form a substantially rectangular wire frame which can be collapsed into a flat condition prior to use.

8. The holder recited in claim 7 further comprising:

loops at the corners of said rectangular frame encompassing the adjoining wire pieces.

9. The holder recited in claim 1 wherein the junctions between said pieces are welded.

10. The holder of claim 1 in combination with a conventional trash container, said holder being an insert in said container to convert it for use with plastic bags.

11. A holder for open mouth plastic bags having integral loop handles disposed on opposite of the mouth thereof comprising:

two base longitudinal wire pieces;

two base wire pieces extending at one end thereof perpendicularly from the ends of said longitudinal wire pieces;

four vertical wire pieces extending at one end thereof from the junctions of said base longitudinal wire pieces and said two base wire pieces;

two top longitudinal wire pieces extending between the other ends of said vertical wire pieces;

two top wire pieces extending from the junctions of said vertical wire pieces and said two base wire pieces;

said wire pieces forming a substantially rectangular wire frame which can be collapsed into a flat condition prior to use;

tabs integrally formed from said two top wire pieces intermediate the ends thereof, said tabs each comprising three integral sections of one of said top wire pieces, two of said sections extending downwardly from one of said top wire pieces and integrally connected to each other at the lower ends of said two sections by an integral third section, said tabs extending downwardly from said two top wire pieces for suspending one of the bags held in an open position by the handles looped over said tabs and in engagement with said downwardly extending sections of said tabs, said tabs extending downwardly through the openings in the handles to prevent the handles from being easily dislodged from said tabs.

12. The holder recited in claim 11 wherein said tabs extend downwardly from said two top wire pieces at an angle of about 30°–45° from the horizontal when said holder is assembled for use.

* * * * *